United States Patent [19]

Fujita et al.

[11] 4,094,151

[45] June 13, 1978

[54] ANTI-FREEZING METHOD AND APPARATUS FOR GROUND SURROUNDING LIQUIFIED GAS STORING UNDERGROUND TANK

[75] Inventors: Hiroshi Fujita, Tokyo; Munetaka Kubota, Hino; Takashi Makita, Yokosuka; Yukishige Takahashi, Mitaka, all of Japan

[73] Assignee: Kajima Kensetsu Kabushiki Kaisha, Tokyo, Japan

[21] Appl. No.: 788,960

[22] Filed: Apr. 19, 1977

[51] Int. Cl.[2] ..... E02D 27/38; F17C 13/10

[52] U.S. Cl. ..... 61/36 A; 61/0.5; 62/260; 166/45; 166/DIG. 21

[58] Field of Search ..... 61/36 A, 0.5, 11; 62/260; 165/45, DIG. 21

[56] References Cited

U.S. PATENT DOCUMENTS

| | | | |
|---|---|---|---|
| 2,332,227 | 10/1943 | Jackson | 61/36 A |
| 3,076,317 | 2/1963 | La Fave | 61/0.5 |
| 3,183,675 | 5/1965 | Schrobder | 61/36 A |
| 3,859,798 | 1/1975 | Terashima et al. | 61/11 |
| 3,952,531 | 4/1976 | Turner | 61/0.5 |
| 3,990,249 | 11/1976 | Senn | 61/36 A |
| 4,000,851 | 1/1977 | Heilemann | 165/45 |

FOREIGN PATENT DOCUMENTS

| | | | |
|---|---|---|---|
| 953,119 | 8/1974 | Canada | 61/36 A |

*Primary Examiner*—Paul R. Gilliam
*Assistant Examiner*—Alex Grosz
*Attorney, Agent, or Firm*—Meyer, Tilberry & Body

[57] ABSTRACT

The ground surrounding a liquified gas storing underground tank is excavated into a form of a columnar cavity or wall shaped cavity, and then a synthetic resin bag or envelope is placed therein, after which granular materials such as sand or gravel is filled therein, thus forming a water permeable body of a columnar shape or wall-like shape. Then, water is injected into the water permeable body from its bottom and then discharged from the top of the body, thereby warming the peripheral ground of the underground tank for preventing freezing thereof. An apparatus for preventing the freezing of a liquified gas storing underground tank is also disclosed, which includes water feeding and discharging devices provided for the aforesaid water permeable body.

6 Claims, 7 Drawing Figures

ANTI-FREEZING METHOD AND APPARATUS FOR GROUND SURROUNDING LIQUIFIED GAS STORING UNDERGROUND TANK

DETAILED DESCRIPTION OF THE INVENTION

This invention relates to a method and an apparatus for anti-freezing of the ground surrounding a liquified gas storing underground tank.

In general, the ground surrounding a liquified gas storing underground is necessarily frozen because of an extremely low (sub-zero) temperature of liquified gas, with the result that a pressure is produced due to freezing and resulting expansion of water, and the pressure thus produced acts on a body proper and the peripheral construction of the tank, thus impairing the safety of the tank.

For this reason, there has been proposed an attempt such as to provide a protective wall around the tank or to pump out underground water in the peripheral ground of the tank for reducing a pressure caused by the freezing of water. However, the former attempt poses a problem that there is required an expenditure of much time and efforts for the construction of a protective wall, and in addition, the construction of the tank itself should be high in strength, thus increasing the cost of construction of an underground tank. The latter attempt suffers from disadvantages in that pumping of underground water for a long period of time, and the operation is attended with difficulties, and the safety of the underground tank can not be necessarily be insured, in the event of a trouble of a pump device.

It is accordingly a principal object of the present invention to provide a method and an apparatus for anti-freezing of the ground around the tank, by warming same with water being circulated.

It is another object of the present invention to provide a method and an apparatus for anti-freezing of the ground surrounding an underground tank, which are simple in operation and control, and may warm the ground in an efficient manner.

It is a still another object of the present invention to provide a method and an apparatus for anti-freezing of the ground surrounding a tank, which allows a simple construction with less expensive materials and equipments.

It is a yet another object of the present invention to provide a method and an apparatus for anti-freezing of the ground surrounding a tank, which permits the stable and safe use of the tank for a long period of time.

According to the present invention, there is provided a method for anti-freezing of the ground surrounding a liquified gas storing underground tank, in which the ground is excavated into a columnar or wall-shaped cavity and then a water impermeable envelope is placed therein, after which granular materials such as sand and/or gravel is filled therein, thereby providing a columnar or wall-shaped water permeable body. In addition, water at a given temperature is fed into the water permeable body for warming the ground surrounding the tank to prevent the freezing thereof.

In addition, according to the present invention, there is provided an apparatus for use in the aforesaid method, which includes water feeding and discharging devices are provided for feeding and discharging water into or from the aforesaid water permeable body.

DESCRIPTION OF THE PREFERRED EMBODIMENTS

Figure 1:
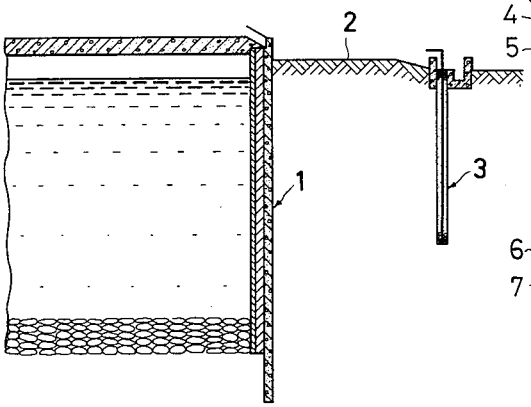
FIG. 1 is a longitudinal cross-sectional view of an anti-freezing apparatus according to the present invention.

In FIG. 1, water permeable bodies 3 of the number required are buried in the ground 2 surrounding a liquified gas storing underground tank 1, and then water at a given temperature is continuously introduced into the water permeable bodies to fill up the water permeable bodies from their bottoms to their tips, and then water is discharged from the tops, respectively. The ground around the water permeable bodies 3 may be warmed with the above water, so that the freezing of ground may be prevented.

Figure 2A:
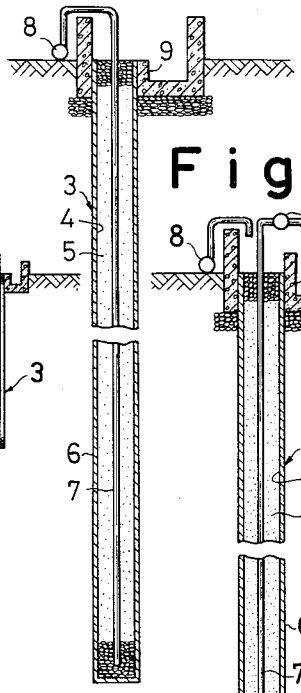
FIGS. 2A and 2B are longitudinal cross-sectional, detailed views of the anti-freezing apparatus according to the present invention.

The water permeable body 3 may be prepared by excavating the peripheral ground 2 into a vertical hole 4 and then charging granular materials 5 such as sand or gravel therein. Thus, water permeable body 3 of columnar or wall-shape may be formed, with its periphery enclosed with a water impermeable envelope or bag 6. In FIG. 2A, a water feeding pipe 7 is inserted into the water permeable body 3, so that water at a given temperature may be fed into the water permeable body 3 from its bottom continuously. Water injected into the water permeable body 3 fills the body 3 from its bottom to its top, progressively, through the granular materials filled therein, after which water is discharged into a water discharge channel 9 which is provided close to the top of the body 3 and leads to a river or the like, or water is warmed again to a given temperature and then supplied to the water permeable body 3 through the water feeding pipe 7.

Figure 2B:
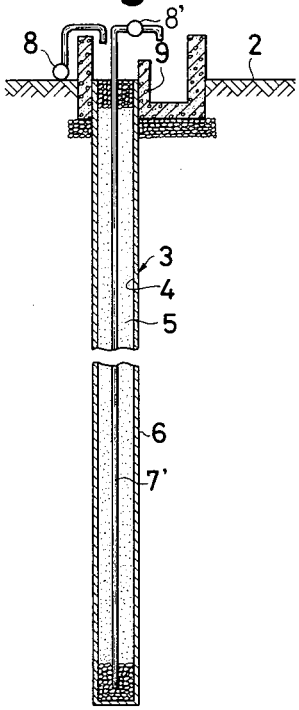

As another embodiment, as shown in FIG. 2B, water having a given temperature may be continuously injected into the water permeable body 3 from its top portion through the pump 8. The water injected into the water permeable body 3 permeates through the granular materials down to the bottom of the water permeable body 3, and then the water may be pumped up by a pump 8' through a drain pipe 7' and collected into the water discharge channel 9.

The temperature and amount of water to be injected into the water permeable body 3 depends on the temperature of the peripheral ground of the water permeable body 3, the volume and number of the bodies 3.

FIGS. 3 to 6 show the steps of the method for constructing the anti-freezing apparatus according to the present invention.

Figure 3:
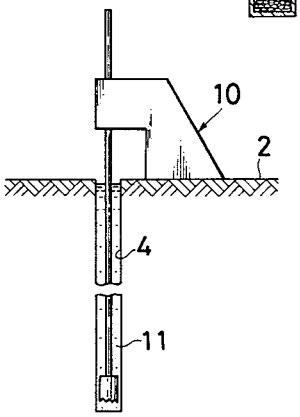
FIGS. 3, 4, 5 and 6 are longitudinal cross-sectional views of the anti-freezing apparatus according to the present invention, which are given in the order of its construction.
Figure 4:
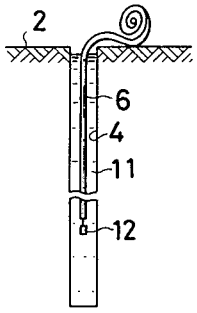
Figure 5:
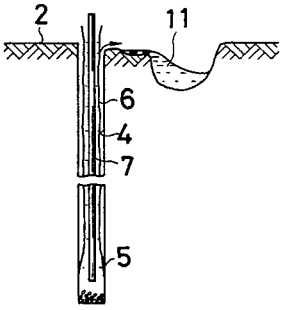
Figure 6:
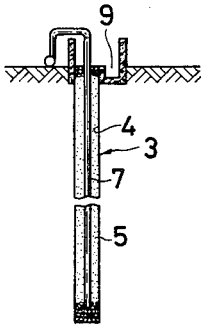

As shown in FIG. 3, the ground is excavated by means of an excavator 10 by using a bentonite solution 11, thereby forming a vertical hole 4. Then, as shown in FIG. 4, an envelope or bag 6 made of water impermeable sheet such as a synthetic resin sheet and having a weight 12 at its lower end is inserted into the vertical hole 4. Then, the water feeding pipe 7 is inserted into the vertical hole 4. Then, the water feeding pipe 7 is inserted into the envelope 6 and thereafter, as shown in FIG. 5, gravel is first filled therein, followed by sand, and finally gravel again, thereby forming the water permeable body 3 consisting of granular materials. Meanwhile, the bentonite solution 11 which has overflown from the top of the hole 4 due to the charging of granular materials 5 therein is discharged as required. Finally, a water discharge channel 9 is provided close to the top of the water permeable body 3, as shown in FIG. 6, and then the water feeding pipe 7 is connected to a pump 8.

Meanwhile, the water permeable body 3 may consist of a steel pipe inserted into the ground, with the interior thereof filled with granular materials 5. In addition, water may be introduced into the water permeable body from its top and then pumped from its bottom through a water discharge pipe.

What is claimed is:

1. Apparatus for warming ground about an underground cryogenic storage tank comprising: a vertically disposed water impermeable envelope embedded in the ground adjacent to said tank, said envelope being filled with granular material; a source of water for said envelope; water conveying means in said envelope extending from the upper to the lower portion of said envelope; said water conveying means being in communication at its lower end with the interior of said envelope and being in communication at its upper end with water impelling means adapted to move water through said envelope; and means to dispose of excess water from said envelope.

2. The apparatus of claim 1, wherein said water impelling means urges water downwardly through said water conveying means to enter said envelope at the lower end of said water conveying means, whereby said water percolates upwardly through said granular material to said excess water disposal means.

3. The apparatus of claim 1, wherein said water impelling means urges water upwardly through said water conveying means thereby causing said water in said envelope to percolate downwardly through said granular material.

4. The method of warming ground around an underground cryogenic tank comprising the steps of:

embedding a water impermeable envelope in the ground adjacent to said tank;

filling said envelope with granular material;

percolating water through said granular material; and disposing of excess water from said envelope.

5. The method of claim 4, including the steps of:

passing water from the top to the bottom of said envelope, and permitting said water to percolate upwardly through said granular material.

6. The method of claim 4, including the steps of:

percolating water downwardly through said granular material;

drawing said water to the surface of said granular material, and withdrawing said water from said envelope.

* * * * *